US007583034B2

(12) United States Patent
Lara-Ascorra et al.

(10) Patent No.: US 7,583,034 B2
(45) Date of Patent: Sep. 1, 2009

(54) LED CONTROLLER AND METHOD THEREFOR

(75) Inventors: Alejandro Lara-Ascorra, Gilbert, AZ (US); Stephen P. Robb, Fountain Hills, AZ (US); Alan R. Ball, Gilbert, AZ (US)

(73) Assignee: Semiconductor Components Industries, L.L.C., Phoenix, AZ (US)

( * ) Notice: Subject to any disclaimer, the term of this patent is extended or adjusted under 35 U.S.C. 154(b) by 536 days.

(21) Appl. No.: 11/535,177

(22) Filed: Sep. 26, 2006

(65) Prior Publication Data

US 2008/0074364 A1 Mar. 27, 2008

(51) Int. Cl.
*G09G 3/32* (2006.01)

(52) U.S. Cl. ..... 315/291; 327/534; 327/538

(58) Field of Classification Search ..... 327/538, 327/539, 540, 541, 534, 535, 536, 537; 315/291, 315/247, 312

See application file for complete search history.

(56) References Cited

U.S. PATENT DOCUMENTS 5,686,857 A * 11/1997 Heminger et al. ..... 327/451
7,015,654 B1 * 3/2006 Kuhlmann et al. ..... 315/291
2005/0212587 A1 9/2005 Meek et al.

OTHER PUBLICATIONS

National Semiconductor Corporation Data Sheet DS200814, "LP3936 Lighting Management System for Six White LEDs and One RGB or FLASH LED", © 2005 , 21 pages.

Maxim Integrated Products Data Sheet, MAX1582/MAX1582Y, "High-Efficiency Step-Up Converters for White LED Main and Subdisplay Backlighting", 19-2783; Rev 2; Aug. 2005, © 2005, 10 pages.

Semiconductor Components Industries, LLC, Data Sheet, "NCP5500, NCV5500, NCP5501, NCV5501 500 mA Linear Regulator", © 2006, Jun. 2006—Rev. 3 Publication Order No. NCP5500/D, 9 pages.

Semiconductor Components Industries, LLC, Data Sheet, "NIS5112 Electronic Fuse", Dec. 2005—Rev. 1 Publication Order No. NIS5112/D, © Semiconductor Components Industries, LLC, 2005, 9 pages.

Fairchild Semionductor Data Sheet, "FAN5611/FAN5612/FAN5613/FAN5614 Low-Dropout LED Drivers for White, Blue or any Color LED", Copyright 2004, Jun. 4, 2004 Stock#DS30005611, 12 pages.

* cited by examiner

*Primary Examiner*—David Hung Vu
(74) *Attorney, Agent, or Firm*—Robert F. Hightower

(57) ABSTRACT

In one embodiment, a vertical N-channel transistor is coupled in a high side configuration to control a current through an LED. A control circuit operates the vertical N-channel transistor to control a value of the current.

20 Claims, 3 Drawing Sheets

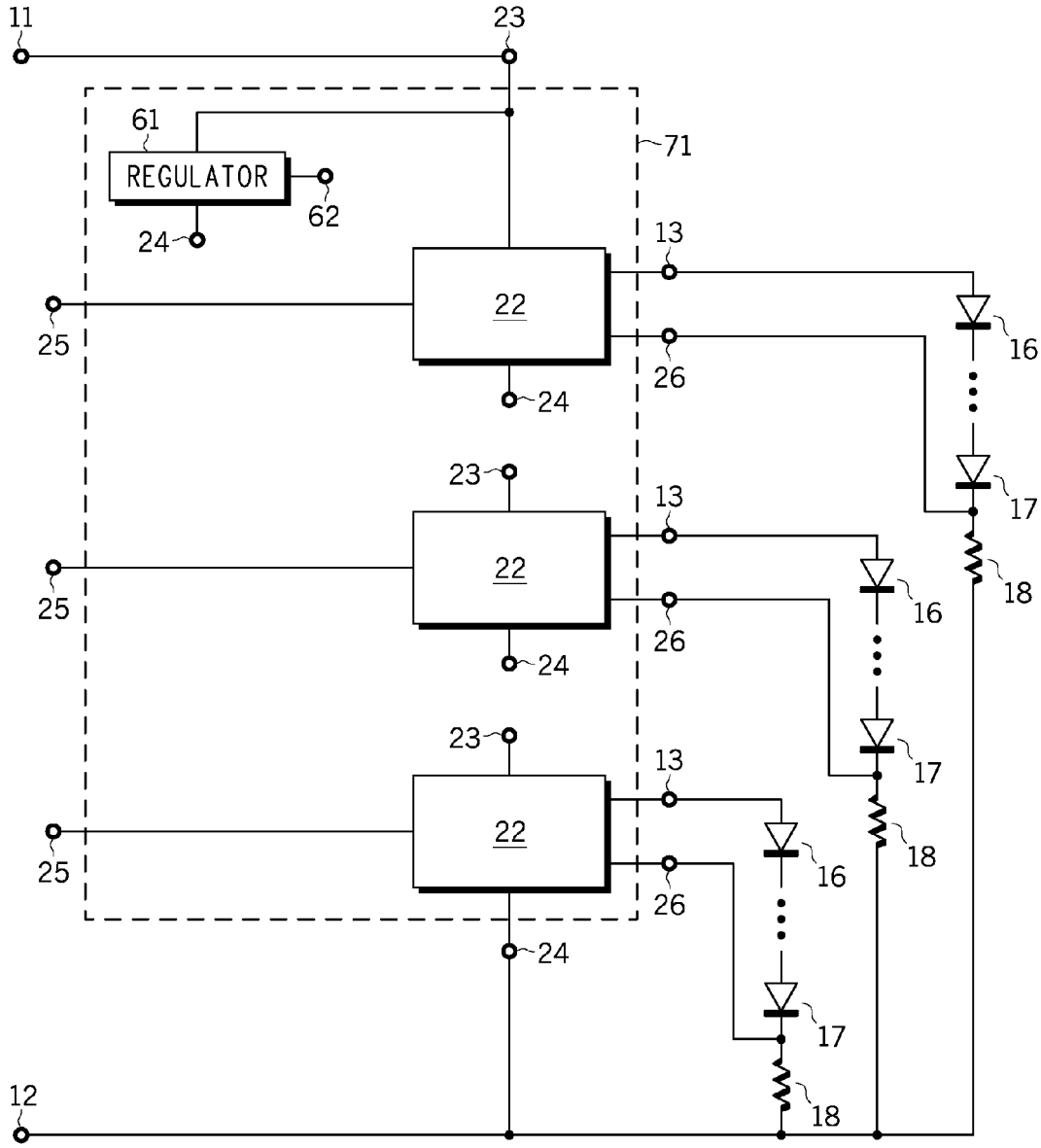
FIG. 2
FIG. 4
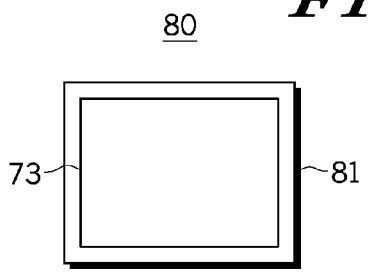

LED CONTROLLER AND METHOD THEREFOR

BACKGROUND OF THE INVENTION

The present invention relates, in general, to electronics, and more particularly, to methods of forming semiconductor devices and structures.

In the past, the semiconductor industry utilized various methods and structures to form control circuits for light emitting diodes (LEDs). Some LED controllers utilized a P-channel metal oxide semiconductor (MOS) transistor that was connected in a high-side configuration in order to regulate the value of a voltage applied to the LED. The P-channel MOS transistor generally resulted in larger die sizes which increased the costs.

In other configurations, an N-channel MOS transistor was connected in a low-side configuration to control the LED. The low-side configuration connected the load to the power supply. If the output of the low-side configuration accidentally became shorted to another connection, large currents could flow through the load and damage the load. One example of an LED controller that uses an N-channel transistor connected in a low-side configuration is described in the data sheet of a part referred to as the LP3936 that was available from National Semiconductor of Santa Clara, Calif.

Accordingly, it is desirable to have an LED controller that connects the load via a high-side switch configuration, that does not use a P-channel transistor to control the load, and that has a lower cost.

BRIEF DESCRIPTION OF THE DRAWINGS

FIG. 2 schematically illustrates an embodiment of a portion of a multi-channel LED system that includes a multi-channel LED controller in accordance with the present invention;

FIG. 4 illustrates an enlarged plan view of a semiconductor device that includes the LED controller of FIG. 2 in accordance with the present invention.

For simplicity and clarity of the illustration, elements in the figures are not necessarily to scale, and the same reference numbers in different figures denote the same elements. Additionally, descriptions and details of well-known steps and elements are omitted for simplicity of the description. As used herein current carrying electrode means an element of a device that carries current through the device such as a source or a drain of an MOS transistor or an emitter or a collector of a bipolar transistor or a cathode or anode of a diode, and a control electrode means an element of the device that controls current through the device such as a gate of an MOS transistor or a base of a bipolar transistor. Although the devices are explained herein as certain N-channel or P-Channel devices, a person of ordinary skill in the art will appreciate that complementary devices are also possible in accordance with the present invention. It will be appreciated by those skilled in the art that the words during, while, and when as used herein are not exact terms that mean an action takes place instantly upon an initiating action but that there may be some small but reasonable delay, such as a propagation delay, between the reaction that is initiated by the initial action. For clarity of the drawings, doped regions of device structures are illustrated as having generally straight line edges and precise angular corners. However, those skilled in the art understand that due to the diffusion and activation of dopants the edges of doped regions generally may not be straight lines and the corners may not be precise angles.

DETAILED DESCRIPTION OF THE DRAWINGS

Figure 1:
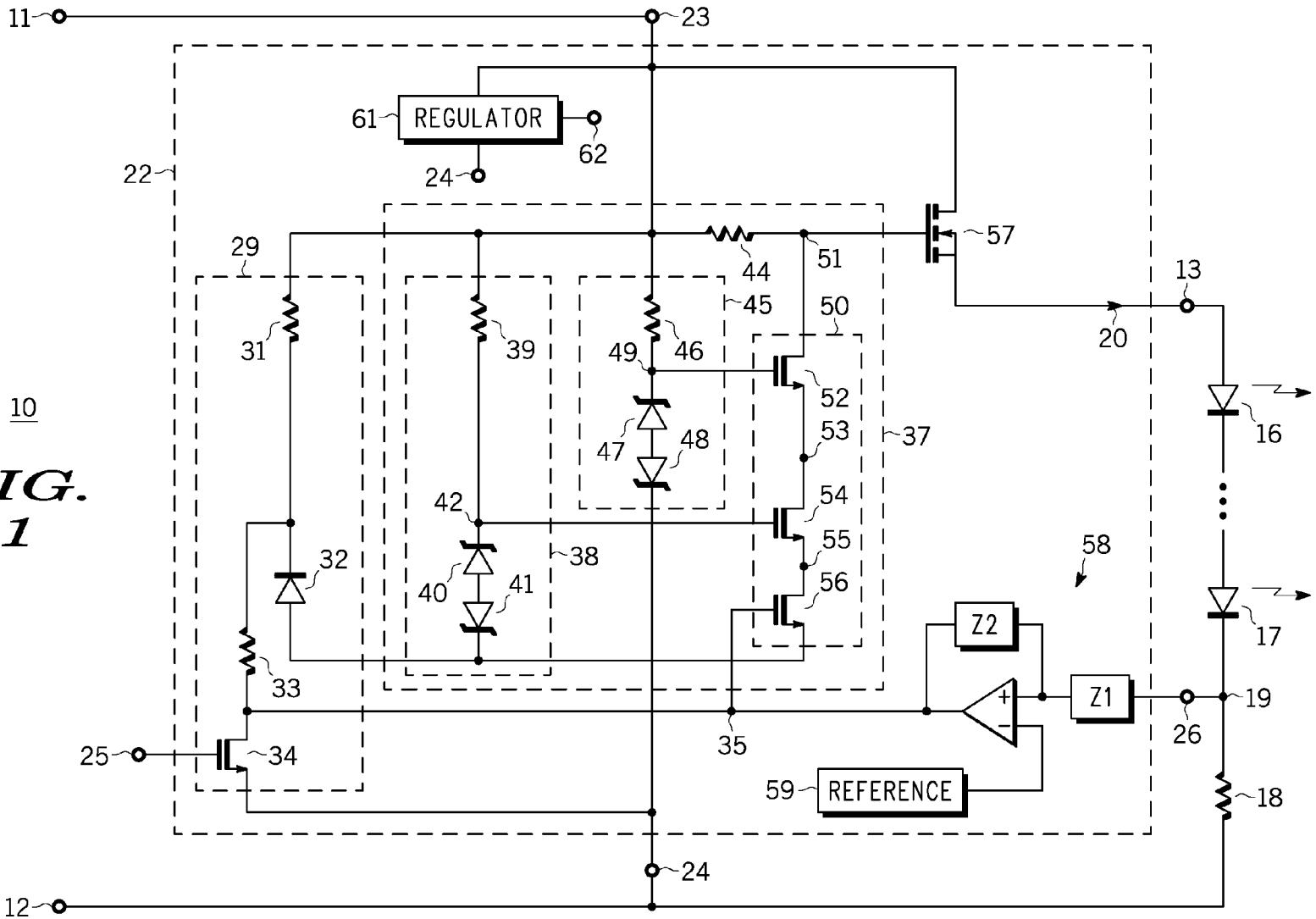
FIG. 1 schematically illustrates an embodiment of a portion of an LED system that includes an LED controller in accordance with the present invention.

FIG. 1 schematically illustrates an embodiment of a portion of an LED system 10 that includes an LED controller 22. Controller 22 utilizes a vertical N-channel MOS transistor 57 that is connected in a high-side configuration to control current through an LED. Controller 22 operates transistor 57 in saturation to linearly control the value of the current flow through transistor 57, thus through the LED, to a substantially constant value. System 10 receives power between a power input terminal 11 and a power return terminal 12. The voltage source connected between terminals 11 and 12 typically is a substantially dc voltage. System 10 also generally includes an LED 16 and typically includes a plurality of series connected LEDs such as LEDs 16 and 17. A current sense resistor 18 generally is also connected in series with the plurality of LEDs in order to form a feedback signal on a node 19 that is representative of the value of a load current 20 that flows through LEDs 16 and 17.

Controller 22 receives power between a voltage input 23 and a voltage return 24 and provides load current 20 through an output 13. Controller 22 receives the feedback signal on a feedback input 26. An optional enable input 25 may be used to enable and disable the operation of controller 22, thus, enable and disable the flow of current 20. Controller 22 generally includes a linear control circuit 37, an enable circuit 29, an error amplifier 58, and a reference signal generator or reference 59. Amplifier 58 generally includes an operational amplifier and impedances, such as impedances Z1 and Z2, that are used to control the gain and provide frequency compensation. Controller 22 may also include an internal voltage regulator 61 that receives the voltage from input 23 and forms an internal operating voltage on an output 62 that may be used for operating some of the elements of controller 22 such as reference 59 and amplifier 58.

Enable circuit 29 generally includes an enable transistor 34 and a pull up resistor 33. A resistor 31 and a diode 32 provide a pull-up voltage received by resistor 33. Linear control circuit 37 generally includes a first bias circuit 38, a second bias circuit 45, and a linear driver 50. Driver 50 includes a plurality of series connected transistors such as a first bias transistor 52, a second bias transistor 54, and a control transistor 56.

In operation, load current 20 is regulated to a substantially constant desired value within a range of values around the desired value. For example, the desired value may be about three hundred milli-amperes (300 ma.) and the range of values may be plus or minus five percent (5%) around the three hundred milli-amperes. Load current 20 flows through LEDs 16 and 17 in addition to resistor 18. The flow of current 20 through resistor 18 forms the feedback signal on feedback node 19 that is representative of the value of current 20. Error amplifier 58 receives the feedback signal and forms an error signal on a node 35 that is representative of the difference between the value of current 20 and the desired value of current 20. Amplifier 58 forms the error signal as the difference between the feedback signal from input 26 and the value of the reference signal from reference 59. As will be understood by those skilled in the art, controller 22 is configured to control the value of current 20 such that the value of the feedback signal is substantially equal to the value of the reference signal. If the value of the enable signal on input 25 is low, transistor 34 is disabled and enable circuit 29 has no effect on the value of the error signal on node 35.

Control transistor 56 receives the error signal from amplifier 58 and controls driver 50 to form a linear control voltage on the gate of transistor 57. A resistor 44 is coupled between driver 50 and input 23 to prevent shorting the gate of transistor 57 to the voltage supply on input 23. The control signal formed by driver 50 operates transistor 57 in the saturated region of the operating characteristics of transistor 57 so that transistor 57 is not fully enhanced, thus, the value of the gate voltage of transistor 57 varies to responsively vary the current through transistor 57. This control of transistor 57 regulates the value of current 20 to the substantially constant desired value. Because transistor 57 is connected in a high-side configuration, the value of the control voltage that must be applied to the gate of transistor 57 generally is very large. Since transistor 57 is a vertical transistor, transistor 57 can be formed to have a high breakdown voltage. However, as will be seen further hereinafter, transistors 52, 54, and 56 are lateral transistors that generally have a lower breakdown voltage than transistor 57. In order to form driver 50 to withstand the large voltages that must be applied to the gate of transistor 57, transistors 52, 54, and 56 are coupled in a series or stacked configuration that distributes the value of the voltage of the control signal across each of transistors 52, 54, and 56. The amount of voltage that is dropped by each of transistors 52, 54, and 56, is controlled by the stacked configuration and by biasing transistor 52 and 54 with a substantially fixed voltage. In the stacked configuration, all of transistors 52, 54, and 56 conduct the same current, thus, the gate-to-source voltage (Vgs) of transistors 52 and 54 is substantially equal. Consequently, the value of the voltage at the source of transistor 52 is the bias voltage minus the Vgs of transistor 52. Since the voltage on the drain is a fixed, the voltage drop across transistor 52 is also fixed. Similarly, the value of the voltage at the source of transistor 54 is the bias voltage minus the Vgs of transistor 54. The voltage on the drain of transistor 54 is fixed by the voltage at the source of transistor 52, thus the voltage drop across transistor 54 is also fixed. Consequently, applying a fixed bias voltage to the gate of each of transistors 52 and 54 controls the value of the voltage dropped by transistors 52 and 54. The remainder of the voltage of the control signal applied to the gate of transistor 57 is dropped across transistor 56. The bias voltages for transistors 52 and 54 are formed by bias circuits 45 and 38. Bias circuit 45 receives the input voltage from input 23 and forms a first bias voltage on the gate of transistor 52 that is less than the value of the input voltage and less than the maximum value of the control voltage that is required to operate transistor 57. Bias circuit 38 forms a second bias voltage on the gate of transistor 54 that is less than the value of the first bias voltage and greater than the maximum value of the error signal from amplifier 58. The value of the bias voltages for transistors 52 and 54 is selected to set the voltage drop across each of transistors 52, 54, and 56 to some portion of the maximum value of the voltage of the control signal applied to the gate of transistor 57. In the preferred embodiment, the bias voltages are selected to drop approximately one third of the maximum voltage of the control signal. The operation of transistor 56 is controlled by the value of the error signal from amplifier 58. As the value of the error signal changes or varies, the Vgs of transistor 56 varies thereby varying the value of the control signal on the gate of transistor 57 to control the value of current 20.

In one example embodiment, the value of the input voltage received between input 23 and return 24 was approximately one hundred volts (100 V). The first bias voltage on node 49 was selected to be approximately sixty five volts (65 V) and the second bias voltage on node 42 was selected to be approximately thirty five volts (35 V). The value of the current flowing through transistors 52, 54, and 56 formed the Vgs of transistors 52 and 54 at approximately four volts (4 V). Consequently, the value of the voltage on node 53 was approximately sixty one volts (61 V) so that transistor 52 dropped approximately thirty nine volts (39 V). The value of the voltage on node 55 was approximately thirty one volts (31 V) so that transistor 54 dropped approximately thirty volts (30 V). Subtracting the voltage dropped across transistors 52 and 54 from the one hundred volt (100 V) input voltage left approximately thirty one volts (31 V) across transistor 56. Consequently, the stacked configuration in addition to applying the substantially fixed bias voltages to transistors 52 and 54 spreads or distributes the value of the voltage that must be dropped by transistors 52, 54, and 56 across each of the transistors so that transistors 52, 54, and 56 may have a lower breakdown voltage than the breakdown voltage of transistor 57. It will be appreciated by those skilled in the art that if the gates of transistors 52, 54, and 56 were all driven by the same voltage, such as the error signal, one of the transistors would drop approximately all of the value of the control voltage and the other transistors would turn fully on to conduct current. Thus, substantially all of the voltage would be dropped across one transistor.

Those skilled in the art will appreciate that the configuration of driver 50 facilitates forming a high gate voltage to control transistor 57 without using a charge pump circuit. In applications where N-channel transistors are coupled in a high side configuration, it often is necessary to increase the value of the voltage of a control signal in order to create a Vgs that is large enough to control the transistor. A charge pump circuit is typically used to pump-up the value of the control voltage. An example of a circuit that uses a charge pump to control an N-channel MOS transistor coupled in a high-side configuration is described in a data sheet for a part referred to as an NIS5112 from ON Semiconductor of Phoenix, Ariz. Driver 50 facilitates forming the control signal to drive transistor 57 without using a charge pump circuit, thereby decreasing the cost of a system that uses controller 22. Not using a charge-pump also eliminates the electro-magnetic interference (EMI) caused by the switching of the charge-pump. In configurations that drive an N-channel transistor in a high-side configuration using a charge-pump, the gate voltage applied to the transistor has to be greater than the voltage on the drain of the transistor. Since circuit 37 drives transistor 57 without the use of a charge-pump, the gate voltage applied to transistor 57 is not greater than the voltage on the drain of transistor 57.

In order to implement this functionality for controller 22, a drain of transistor 57 is connected to receive the input voltage through resistor 44 and the source is connected to supply load current 20 to external LEDs 16 and 17. The drain of transistor 57 is connected to one terminal of resistor 44 which has a second terminal connected to input 23. The source of transistor 57 is connected to output 13. The gate of transistor 57 is connected to node 51. A drain of transistor 52 is connected to node 51, the gate is connected to node 49, and a source is connected to node 53. The drain of transistor 54 is connected to node 53, the gate is connected to node 42, and the source is connected to node 55. The drain of transistor 56 is connected to node 55, the gate is connected to node 35, and a source is connected to return 24. An input of bias circuit 45 is connected to input 23 and to a first terminal of a resistor 46. A second terminal of resistor 46 is connected to node 49. A cathode of diode 47 is connected to node 49 and an anode is connected to an anode of a diode 48 which has a cathode connected to return 24. An input of circuit 38 is connected to input 23 and to a first terminal of resistor 39 which has a second terminal connected to node 42. A cathode of a diode 40 is connected to node 42 and an anode is connected to an anode of a diode 41. A cathode of diode 41 is connected to return 24. An input of enable circuit 29 is connected to input 23 and to a first terminal of a resistor 31. A second terminal of resistor 31 is commonly connected to a cathode of a diode 32 and to a first terminal of a resistor 33. An anode of diode 32 is connected to return 24. A second terminal of resistor 33 is commonly connected to node 35 and a drain of transistor 34. A source of transistor 34 is connected to return 24 and a gate is connected to input 25. A non-inverting input of amplifier 58 is connected to input 26 and an inverting input is connected to receive the reference signal from reference 59. An output of amplifier 58 is connected to node 35.

Those skilled in the art will appreciate that circuits 45 and 38 represent exemplary forms of a bias circuit for forming the bias voltages for transistors 52 and 54, and that other circuits may be used to form the bias voltages. Additionally, driver 50 may include fewer or greater numbers of stacked transistors than transistors 52, 54, and 56 as needed to distribute the value of the control voltage across the transistors and the breakdown voltages thereof. Additionally, transistor 57 may be a SENSEFET type of transistor that forms the feedback signal from the sense portion of the SENSEFET. SENSEFET is a trademark of Semiconductor Components Industries, LLC (SCILLC) of Phoenix, Ariz. One example of a SENSEFET type of transistor is disclosed in U.S. Pat. No. 4,553,084 issued to Robert Wrathall on Nov. 12, 1985, which is hereby incorporated herein by reference FIG. 2 schematically illustrates a generalized block diagram of a portion of an exemplary embodiment of a multi-channel LED system 70 that includes a multi-channel LED controller 71. System 70 has a plurality of channels where each channel generally includes an LED 16 and typically includes a plurality of LEDs 16 and 17. Controller 71 includes a plurality of LED controllers that are substantially the same as controller 22 that was explained in the description of FIG. 1. Controller 71 typically has a single regulator 61 and controllers 22 do not include regulator 61.

Figure 3:
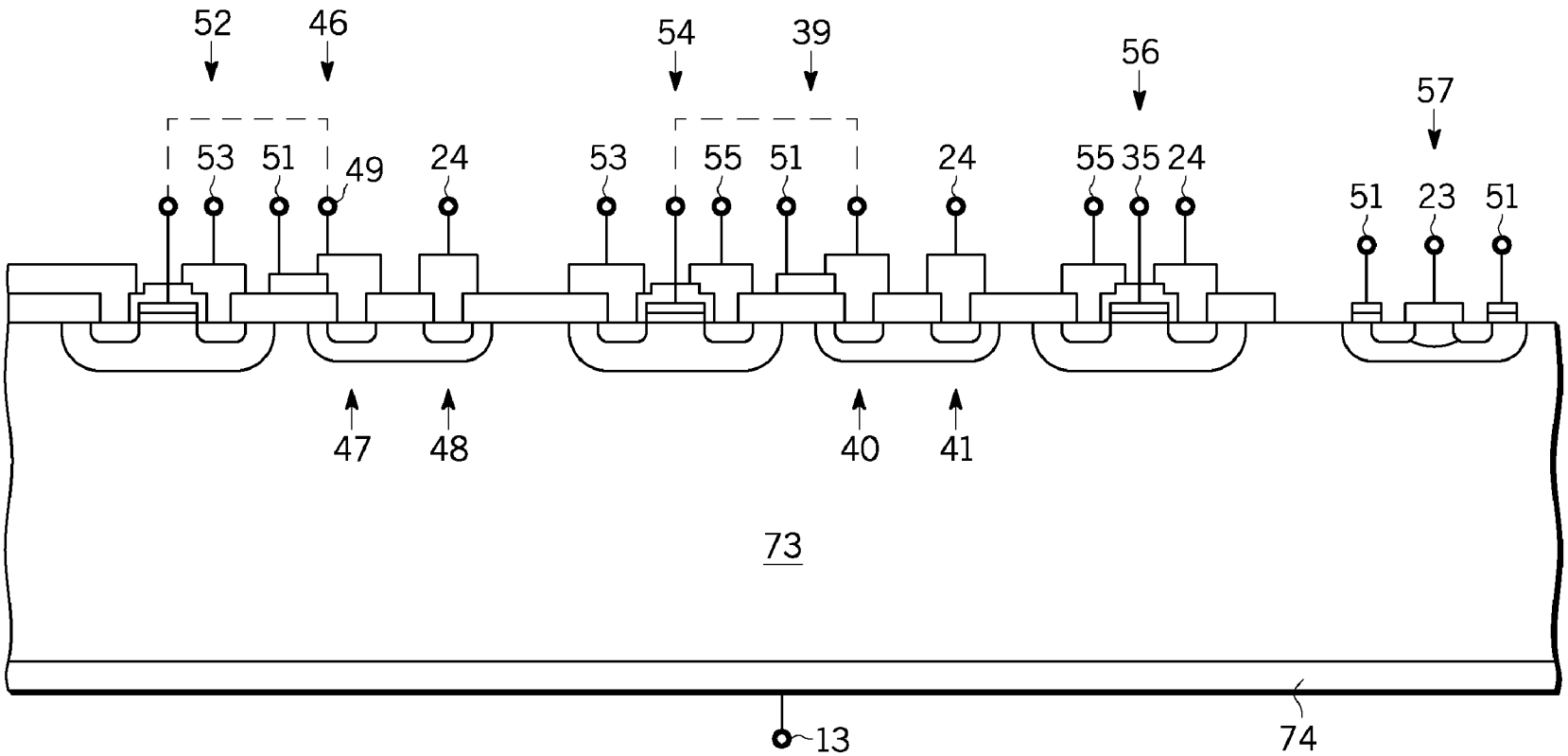
FIG. 3 schematically illustrates an enlarged cross-sectional portion of the LED controller of FIG. 2 accordance with the present invention.

FIG. 3 illustrates an enlarged cross-sectional portion of a semiconductor device or integrated circuit 81 that includes an LED controller such as controller 22 or controller 71. Device 81 is formed on a semiconductor substrate 73 that has a conductor 74 on a first surface of substrate 73 that provides electrical connection to the drain of transistor 57. Lateral transistors 52, 54, and 56 are formed on a second surface of substrate 73 that is opposite the first surface. Vertical transistor 57 is formed on the second surface and extends through substrate 73 so that the current flow path extends through substrate 73 to conductor 74.

Transistor 57 is illustrated as a single cell or single body design. However, those skilled in the art will appreciate that transistor 57 may be either a cellular design (where the body regions are a plurality of cellular regions) or a single body design.

FIG. 4 schematically illustrates an enlarged plan view of a portion of an embodiment of semiconductor device or integrated circuit 81 that is formed on semiconductor substrate 73. Controller 22 or controller 71 may be formed on substrate 73. Substrate 73 may also include other circuits that are not shown in FIG. 4 for simplicity of the drawing. Controller 71 and device or integrated circuit 81 are formed on substrate 73 by semiconductor manufacturing techniques that are well known to those skilled in the art.

In view of all of the above, it is evident that a novel device and method is disclosed. Included, among other features, is coupling a vertical N-channel MOS transistor in a high side configuration to control a high voltage without using a charge pump circuit to generate the signal to drive the gate of the transistor. Eliminating the need for a charge pump reduces the costs of the system. Biasing a transistor of a plurality of stacked transistors with a substantially fixed bias voltage facilitates using the transistors in an application that requires a breakdown voltage that is greater than the breakdown voltage of the individual transistors. Using a vertical N-channel transistor also facilitates forming multiple channels with each channel connected in a high-side configuration all on one semiconductor die. The N-channel transistors are smaller than P-channel transistors which lowers the costs.

While the subject matter of the invention is described with specific preferred embodiments, it is evident that many alternatives and variations will be apparent to those skilled in the semiconductor arts. Additionally, the word "connected" is used throughout for clarity of the description, however, it is intended to have the same meaning as the word "coupled". Accordingly, "connected" should be interpreted as including either a direct connection or an indirect connection.

The invention claimed is:

1. An LED controller comprising:

a vertical N-channel transistor having a gate, having a drain coupled to receive an input voltage, and having a source coupled to supply a load current to an LED; and a control circuit operably coupled to supply a control voltage to the gate of the vertical N-channel transistor that is representative of a difference between the load current and a desired value of the load current wherein the control voltage is no greater than a voltage on the drain.

2. The LED controller of claim 1 further including an amplifier that receives a signal that is representative of the load current and forms an error signal that is representative of the difference between the load current and the desired value of the load current.

3. The LED controller of claim 1 wherein the control circuit includes a plurality of transistors connected in series between the gate of the vertical N-channel transistor wherein a first transistor of the plurality of transistors is biased at a first bias voltage that is less than a maximum value of the control voltage and wherein a second transistor of the plurality of transistors is operably coupled to receive an error signal that is representative of the difference between the load current and the desired value of the load current and wherein the second transistor controls the control circuit to form the control voltage.

4. The LED controller of claim 3 wherein the control circuit includes a third transistor coupled in series between the first transistor and the second transistor, the third transistor operably coupled to be biased at a second bias voltage that is less than the first bias voltage and greater than a maximum value of the error signal.

5. The LED controller of claim 4 wherein the first transistor, the second transistor, and the third transistor are lateral N-channel transistors that are formed on semiconductor substrate on which the vertical N-channel transistor is also formed.

6. The LED controller of claim 5 wherein a breakdown voltage of the first, second, and third transistors is less than a maximum value of the control voltage.

7. The LED controller of claim 1 wherein the control voltage varies substantially linearly to variations in the load current.

8. The LED controller of claim 1 wherein the source of the vertical N-channel transistor is coupled to a current output terminal of the LED controller, the LED controller including a first transistor having a drain coupled to the gate of the vertical N-channel transistor, having a gate coupled to receive a first bias voltage having a first value that is less than a maximum value of the control voltage, and having a source, a second transistor having a gate coupled to receive an error signal that is representative of the difference between the load current and the desired value of the load current, having a drain coupled to control a voltage on the drain of the first transistor, and having a source coupled to a voltage return.

9. The LED controller of claim 8 further including a third transistor having a gate operably coupled to receive a second bias voltage having a second value that is less than the first value, a drain coupled to the source of the first transistor, and a source coupled to the drain of the second transistor.

10. The LED controller of claim 9 further including a first bias circuit including a first resistor coupled to receive the input voltage, a first diode having a cathode coupled to the gate of the first transistor and coupled to receive a voltage from the first resistor and an anode, a second diode having an anode coupled to the anode of the first diode and a cathode coupled to the voltage return, a second bias circuit having a second resistor coupled to receive the input voltage, a third diode having a cathode coupled to the gate of the third transistor and coupled to receive a voltage from the first resistor and an anode, a fourth diode having an anode coupled to the anode of the third diode and a cathode coupled to the voltage return.

11. A method of forming an LED controller comprising:

configuring vertical N-channel transistor to receive a power supply voltage on a drain of the vertical N-channel transistor and supply a load current to an LED through a source of the vertical N-channel transistor wherein a gate of the vertical N-channel transistor receives a control voltage that operates the vertical N-channel transistor in a saturated region of the operating characteristics of the vertical N-channel transistor; and configuring a control circuit to form the control voltage without using a charge pump circuit.

12. The method of claim 11 wherein configuring the control circuit to form the control voltage includes configuring the control circuit to receive an error signal that is representative of a difference between the load current and a desired value of the load current and responsively form the control voltage that is representative of difference between the load current and a desired value of the load current wherein the control voltage controls the vertical N-channel transistor to operate in a saturated region of the operational characteristics of the vertical N-channel transistor.

13. The method of claim 11 wherein configuring the control circuit to form the control voltage without using the charge pump circuit includes configuring a plurality of transistors in series, coupling one transistor of the plurality of transistors to receive a linear error signal that is representative of a difference between the load current and a desired value of the load current, and configuring a second transistor of the plurality of transistors to receive a first bias voltage and operate in a liner range of the operational characteristics of the second transistor.

14. The method of claim 13 further including operably coupling an amplifier to receive a sense signal that is representative of the load current and form the linear error signal.

15. The method of claim 13 wherein configuring the second transistor of the plurality of transistors to receive the first bias voltage includes configuring the second transistor to receive a substantially fixed first bias voltage having a value that is less than a maximum value of the control voltage.

16. The method of claim 15 further including configuring a third transistor of the plurality of transistors to receive a second bias voltage that is less than the first bias voltage.

17. A method of forming an LED controller comprising:

forming a vertical N-channel transistor on a semiconductor substrate;

coupling the vertical N-channel transistor to receive an input voltage and form a load current for an LED; and configuring a control circuit to operate the vertical N-channel transistor in saturation to control a value of the load current.

18. The method of claim 17 wherein configuring the control circuit to operate the vertical N-channel transistor in saturation includes coupling a plurality of transistors in series wherein a first transistor of the plurality of transistors operates responsively to an error signal that is representative of a difference between the load current and a desired value of the load current, and each of the other transistors of the plurality of transistors drop a portion of a voltage applied to a gate of the vertical N-channel transistor.

19. The method of claim 18 wherein configuring the control circuit to operate the vertical N-channel transistor includes configuring the control circuit to operate the vertical N-channel transistor without using a charge pump circuit.

20. The method of claim 18 wherein coupling the plurality of transistors in series includes the plurality of transistors on the semiconductor substrate.

* * * * *